United States Patent [19]

Craig et al.

[11] 4,442,799

[45] Apr. 17, 1984

[54] HEAT EXCHANGER

[76] Inventors: Laurence B. Craig, 116 Duck Pond Rd., Glen Cove, N.Y. 11542; Alfred J. Farina, 1939 Anita Ct., Baldwin, N.Y. 11510

[21] Appl. No.: 415,402

[22] Filed: Sep. 7, 1982

[51] Int. Cl.[3] ..... F22B 21/00

[52] U.S. Cl. ..... 122/250 R; 122/367 C; 165/163

[58] Field of Search ..... 122/20 B, 367 C, 250 R; 165/163

[56] References Cited

U.S. PATENT DOCUMENTS

| | | | |
|---|---|---|---|
| 2,163,199 | 6/1939 | Hart | 122/250 R |
| 3,534,712 | 10/1970 | Reynolds | 122/367 C |
| 3,612,004 | 10/1971 | Cancilla et al. | 122/367 C |
| 3,991,821 | 11/1976 | Cook et al. | 122/20 B |
| 4,097,224 | 6/1978 | Cooksley | 122/367 C |
| 4,291,649 | 9/1981 | Boder | 122/20 B |

*Primary Examiner*—Edward G. Favors

*Attorney, Agent, or Firm*—Bauer & Amer

[57] ABSTRACT

In a heat exchanger of the type in which hot exhaust gases transfer heat to water or the like flowing through a helical heat exchange coil, the use, as a significant improvement to the efficiency of the heat exchange occurring therebetween, of a conduit for the water having external helical fluting such that the hot gases circulate along two paths, rather than only one, and thus are more effectively able to transfer heat to the water.

1 Claim, 4 Drawing Figures

HEAT EXCHANGER

Figure 1:
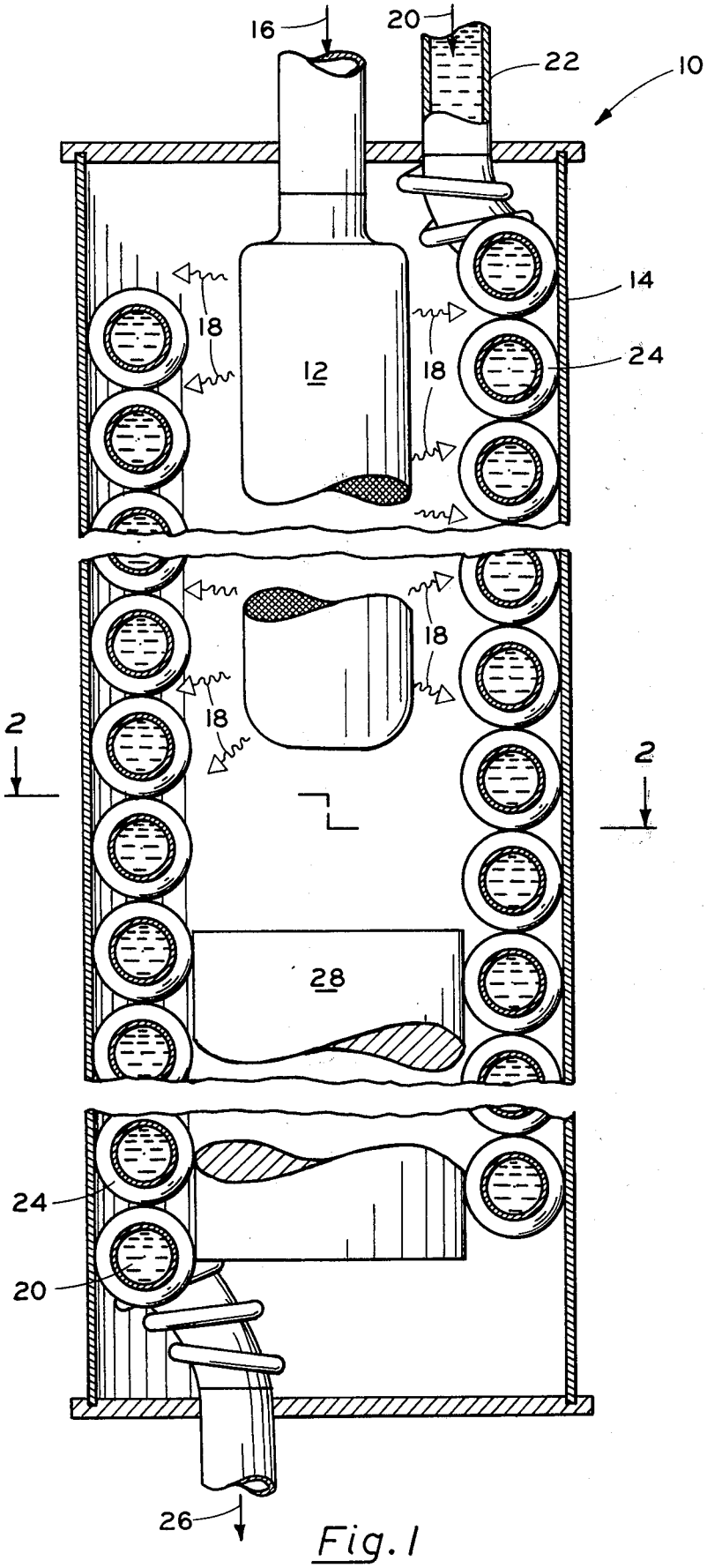

The present invention relates generally to heat exchange apparatus, and more particularly to improvements in the helical coil of such apparatus.

As is well understood in connection with the construction and operational mode of a heat exchanger, the efficiency thereof is primarily a function of effectively prolonging the time in which the heat source and the heat-absorbing fluid are in heat exchange relation with each other. Thus, assuming as is typically the case that the heat source is a hot exhaust gas and that the heat-absorbing or heat exchange fluid is water, the water is pumped through a helical coil to thus provide an elongated path of movement during which the hot exhaust gas circulates through the coil and releases or transfers its heat to the water.

As just noted, therefore, the helical turns or configuration of the conduit for the water or other fluid thus contributes to the efficiency of the heat exchange by lengthening the path of the water. An important contribution of the present invention is the additional recognition that said helical configuration can also be effectively utilized to provide this same important function for the circulating hot exhaust gas, and that by thus lengthening the path of said hot exhaust gas, during which, of course, there is heat transfer therefrom, there is a significant increase in the temperature of the exiting water from the heat exchanger.

Stated somewhat differently, the characterizing aspect of the operational mode of the improved heat exchanger hereof is that the heat-releasing gas thereof is circulated along two paths in heat exchange with the water, and thus has a correspondingly increased opportunity to transfer heat to the water flowing through the helical coil. Moreover, each circulating path of the gas is of a helical nature and thus, like the water, is of an optimum elongated length, all as will be better understood from the description which follows.

An improved heat exchanger demonstrating objects and advantages of the present invention advantageously uses as its heat source a combustion element, such as is described and illustrated in U.S. Pat. No. 3,217,701, which produces, for heat exchange, a hot exhaust gas. In cooperating operative relation to said combustion element and its hot exhaust gas output, there is provided a cylindrical housing and a helical coil disposed in a clearance position in surrounding relation to and along said combustion element, which is of a characteristic elongated shape. Water, as the preferable heat exchange fluid, is pumped through the helical coil incident to establishing heat exchange between the hot gas and said water. In accordance with the present invention, the specific form of the helical soil selected for use is one having surface helical fluting thereabout extending for the length thereof and arranged with the individual helical turns thereof in adjacent relation to each other so as to bound a compartment within the cylindrical housing about the combustion element. The hot gas output of the combustion element has been found in practice to circulate along at least one path that traces along the helical fluting of the helical coil and also along a second path that traces along the clearance between the helical coil and the cylindrical housing, whereby there is an optimum heat exchange which is provided by heat transfer from said two paths of circulating gas and the water flowing through the helical coil. As used herein, the references to "gas" and "air" are interchangeable.

Figure 2:
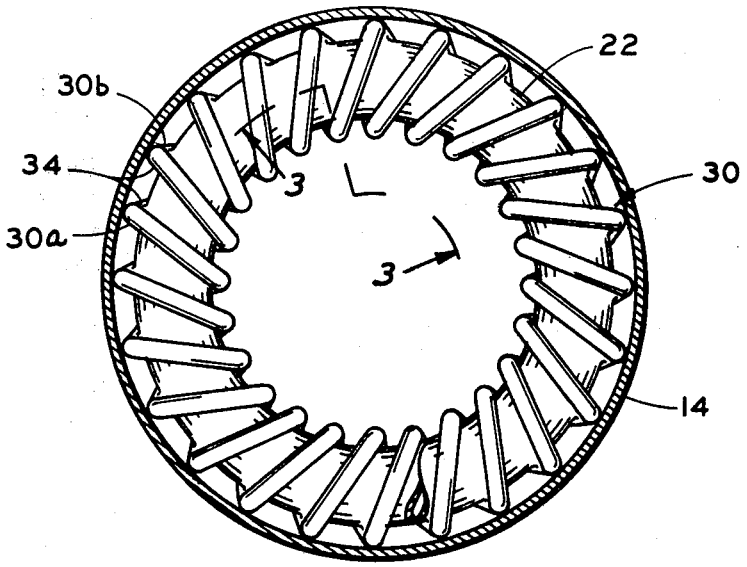
Figure 3:
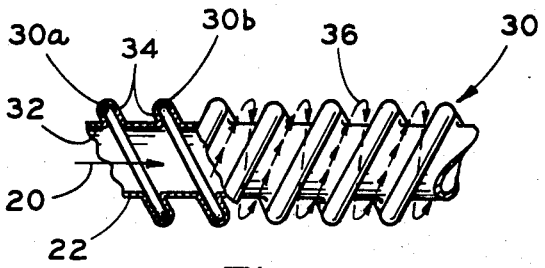
Figure 4:
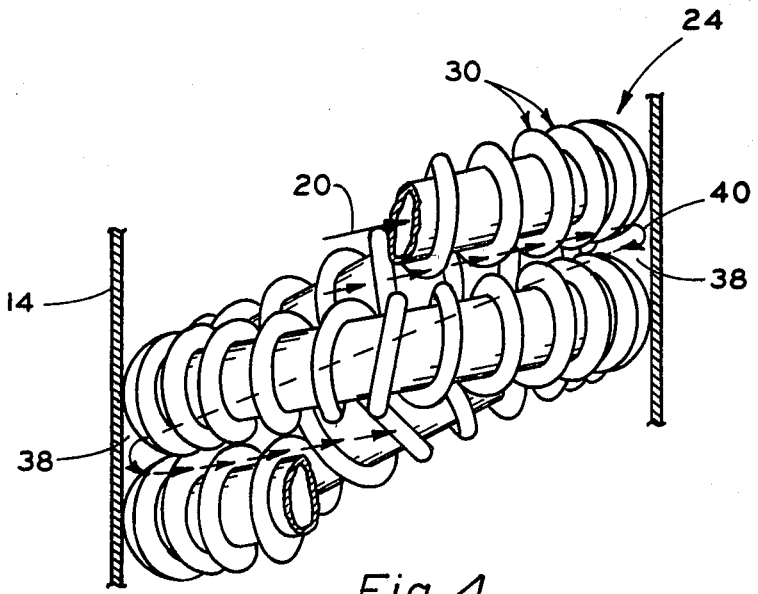
Figure 1:
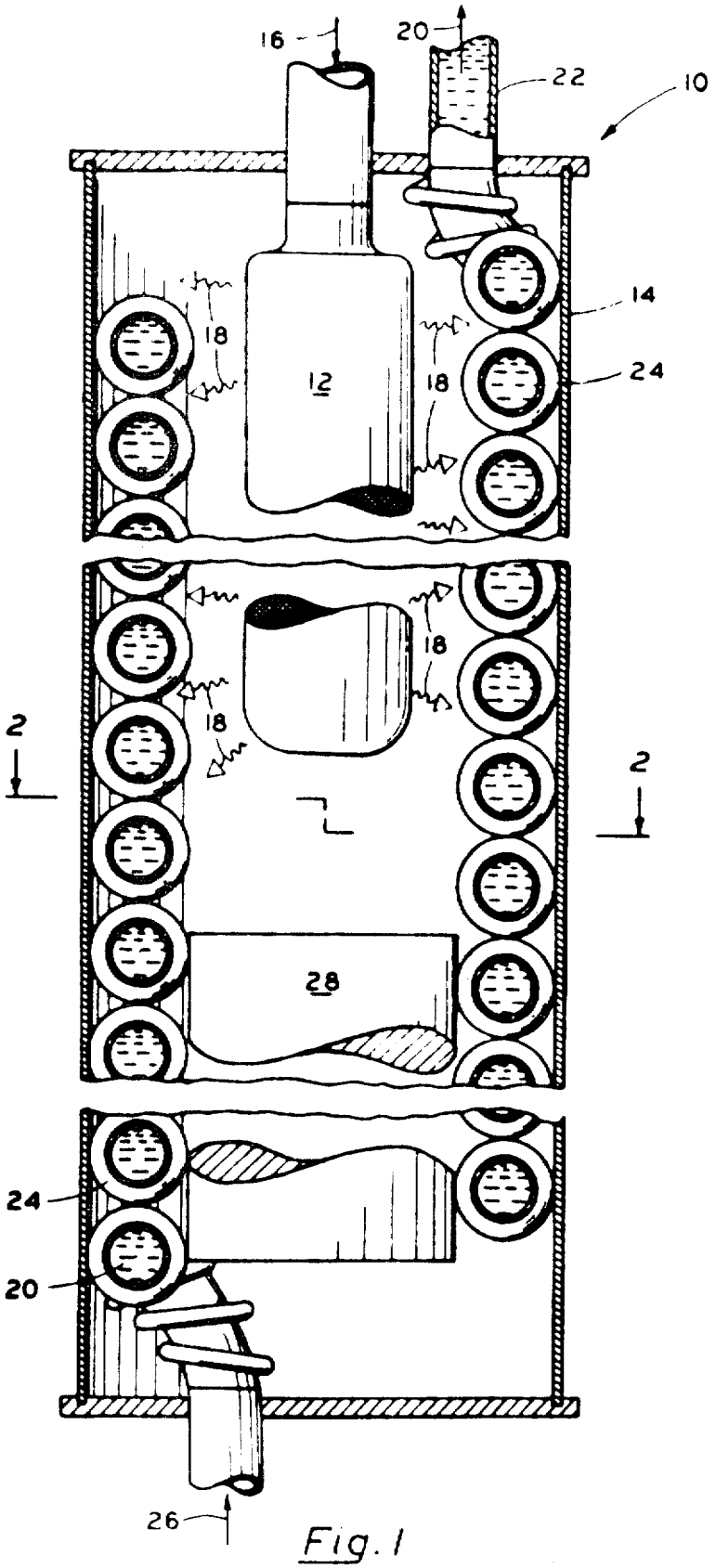

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a side elevational view, in cross-section, of a heat exchanger which otherwise is conventional except that, in accordance with the present invention, there are two paths of circulating air with which there is heat exchange during the functioning of said heat exchanger; and Remaining FIGS. 2–4 are partial views of the coil through which the heat exchange fluid is passed in heat exchange with the just referred-to two paths of circulating air. More particularly, FIG. 2 is a plan view of the coil as seen in the direction of the arrows 2—2 of FIG. 1;

FIG. 3 is an isolated view of a portion of the coil, as seen in the direction of and in section along line 3—3 of FIG. 2 illustrating one of the paths of circulating air with which there is heat exchange; and FIG. 4 is a partial perspective view of the coil in the same perspective as FIG. 3 but illustrating more of the coil, and further illustrating the second path of circulating air with which there is heat exchange.

PRIOR ART

It is already well known, as exemplified by U.S. Pat. No. 3,217,701, issued on Nov. 16, 1965, for "Radiant Heater", and which patent is herewith incorporated by reference in its entirety, that an optimum source of heat that can be used in heat exchange with a flowing fluid, such as water or the like, to heat a dwelling house or other structure is a so-called combustion element which is described in detail and illustrated in the referred-to patent. More particularly, as noted in column 1, lines 9–12 of said referred-to patent, there is considerable patent literature which discloses techniques for manufacture and use of a porous combustion element. Thus, subsequently in said referred-to patent, as at column 4, lines 7–15, it is noted that an optimum source of heat consists of said porous combustion element that in practice is operated by a combustible gas which is forced under pressure through the porous wall of said element. As a result, the outer surface of the element will sustain a combustion reaction at or adjacent the outer peripheral surface layer thereof, such as will cause the outer surface layer to incandesce.

Also noted in said U.S. Pat. No. 3,217,701, as at column 4, lines 63–67, is that in the operation of the referred-to combustion-operated combustion element, that there is an output therefrom in the form of hot exhaust gases possessing suitable energy in the form of convexion heat, and also in the form of direct heat radiation radiating from the incandescent outer surface layer of the combustion element.

With the above understanding, it is the inventive contribution hereof to provide a highly efficient heat exchanger in which the flowing fluid, such as water, is passed in heat exchange with the referred-to hot exhaust gases, just noted, and that such flowing heat exchange fluid then be used in a conventional manner to heat a dwelling house or other structure, or for other such utilitarian purposes.

In terms of the functioning and concept of a heat exchanger, it is of course well known that there are advantages in passing the heat exchange water or fluid through a pipe or conduit that is wound in helical coils and located in the path of the exhaust gases so that a heat exchange can be effectuated between the heat source (i.e. the exhaust gases) and the flowing fluid. Such a conventional heat exchanger is described in detail and illustrated in many U.S. patents, such as U.S. Pat. No. 3,908,604. What particularly distinguishes the within improved heat exchanger is that, unlike prior art heat exchangers, the hot exhaust gases with which there is heat exchange, is circulated along two paths of movement, rather than merely one, during its heat exchange with the flowing water, such that the two circulating paths of movement increase the time duration that the hot exhaust gases can transfer heat to the flowing water, all to the end of significantly increasing the efficiency with which the hot exhaust gases increase the temperature of the heat exchange fluid or water.

THE IMPROVED HEAT EXCHANGER

A preferred embodiment of the within improved heat exchanger, generally designated 10 in FIG. 1, includes many conventional structural features. These include the use of a porous combustion element 12 appropriately mounted in a central clearance position within a cylindrical housing 14 and having communication with a source of combustible gas, as denoted by the arrow 16, which is forced under pressure into the combustion element 12 and through the porosity of its wall construction so that it radiates radially therefrom as noted by the arrows individually and collectively designated 18.

As understood, and as described in detail in the referred-to U.S. Pat. No. 3,217,701, the operation of the combustion element 12 contemplates igniting the combustion gases 18 with the result that at, or near, the periphery of the surface of element 12 there is the referred-to combustion reaction that is manifested by incandescence. As a result, the radially flowing exhaust gases 18 are at an elevated temperature with which it is highly desirable to effectuate a heat transfer to a flowing heat exchange fluid, such as water.

To the above end, the heat exchanger 10 thus also includes a source of water 20 that is pumped through a pipe or conduit 22 that is arranged in helical turns, individually and collectively designated 24, that extend through most of the length of the cylindrical housing 14, such that water that exits through the helical configuration 24, as at 26, is at a temperature which is significantly elevated as compared with the temperature at which it entered the helically-wound conduit 22.

To force the exhaust gases 16 in a radial path 18, as illustrated in FIG. 1, and to prevent the escape thereof centrally through the housing 14 and thus with a minimal heat exchange, the within device 10 includes a plug 28 force-fit or otherwise mounted at the remote end of the cylindrical housing 14.

THE HELICAL COIL

Thus far, what has been described are features which are generally embodied in prior art heat exchangers. What distinguishes the within heat exchanger 10 is a construction and arrangement of the helical coil configuration 24 which results in two heat exchange paths for the hot exhaust gases 16, 18 with respect to the water 20 flowing through the helical coil configuration 24, said construction and arrangement now to be described in detail with particular reference to FIGS. 2, 3, and 4.

As is clearly illustrated in the drawings, the helical coil generally designated 24 is comprised of a conduit or tubing which has as an integral part thereof, i.e. is manufactured with, a spirally or helically fluted construction designated 30. Thus, and as is perhaps best illustrated in the cross-sectional portion of FIG. 3, there are adjacent helical turns of the fluting 30, more particularly designated **30*a* and 30*b*, which extend radially beyond the cylinder wall 22 which bound an external air passage 34 therebetween. It should be readily appreciated that the continuity between the individual air passages 34 provides an overall helical air passage which extends the length of the conduit or tubing 22**.

In FIG. 3, the above-referred to air passage 34 thus provides one of the two paths for the circulating hot exhaust gases 16, 18, said path being designated 36 in FIG. 3.

Referring now specifically to FIG. 4, and recalling from the prior description that the helical coil configuration 24 is enclosed within a cylindrical housing 14, it can be readily appreciated that between adjacent turns of the coil there is a clearance space 38. Thus, some of the hot exhaust gases 16 which have an initial radial movement 18 travel between the adjacent helical turns of the fluting 30 into the spaces 38 between the adjacent turns of the configuration 24. Upon entering the spaces or voids 38, the hot exhaust gases then follow a second helical path designated 40 in FIG. 4.

In the above manner, the circulating hot exhaust gases 16, 18 thus circulate in heat exchange with the fluid 20 along a first path 36 that traces along the helical fluting of the conduit 22 as specifically illustrated in FIG. 3, and also along a second path 40 that traces along the clearance space 38 which exists between the adjacent turns of the helical coil configuration 24 and the cylindrical housing 14, as illustrated in FIG. 4. As a result of the circulation along the two paths 36 and 40 of the hot exhaust gases 16, there is a longer time duration in which the hot exhaust gases can and do transfer heat to the flowing water 20, all to the end of significantly increasing the efficiency with which the hot exhaust gases increase the temperature of the heat exchange fluid or water 20.

For completeness sake, it is noted that spirally or helically fluted tubing, such as tubing 22 described herein, is commercially available from several sources, one such appropriate source being Turbotec Products, Inc., of Winsor, Conn.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

We claim:

1. An improved heat exchanger comprising, in combination, an elongated-shaped means operatively arranged to provide a source of heat eminating radially therefrom and along the length of said elongated shape, a fluid for use in heat exchange with said heat source, a combination cylindrical housing having an exit opening at one end and helical coil disposed in a clearance position in surrounding relation to and along said elongated-shaped heat source for the flowing through said helical coil of said fluid incident to establishing said heat exchange between said heat source and said fluid, said helical coil being in physical contact with said cylindrical housing and having surface helical fluting thereabout extending for the length thereof and arranged with the individual helical turns thereof in adjacent relation to each other so as to bound a compartment within said cylindrical housing about said heat source, a plug located at the end of said compartment to block the flow of air centrally therethrough directly to said exit opening of said cylindrical housing so as to assist in producing air movement radially outwardly therefrom into contact with said helical coil, and pressure means urging air through movement in said compartment for enhancing the transfer of heat from said heat source to said flowing fluid along at least one path that traces along the helical fluting of said helical coil and a second path that traces along the clearance between said helical coil and said cylindrical housing, whereby there is an optimum heat exchange which is provided by heat transfer from said heat source to said two paths of circulating air and from said circulating air to said flowing fluid.

* * * * *

UNITED STATES PATENT AND TRADEMARK OFFICE

CERTIFICATE OF CORRECTION

PATENT NO. : 4,442,799

DATED : April 17, 1984

INVENTOR(S) : Laurence B. Craig et al

It is certified that error appears in the above-identified patent and that said Letters Patent is hereby corrected as shown below:

The title page should appear as per attached title page.

Figure 1 should appear as shown on per attached sheet.

Col. 3, line 46, "20" should read -- 26 --.
line 51, "26" should read -- 20 --.
line 53, "22" should read -- 26 --.
lines 54 and 67, delete "16"

Col. 4, lines 18, 25 and 32, delete "16"
line 40, "16" should read -- 18 --.

Signed and Sealed this

Twentieth Day of November 1984

[SEAL]

Attest:

GERALD J. MOSSINGHOFF

Attesting Officer

Commissioner of Patents and Trademarks

United States Patent [19]

Craig et al.

[11] 4,442,799

[45] Apr. 17, 1984

[54] HEAT EXCHANGER

[76] Inventors: Laurence B. Craig, 116 Duck Pond Rd., Glen Cove, N.Y. 11542; Alfred J. Farina, 1939 Anita Ct., Baldwin, N.Y. 11510

[21] Appl. No.: 415,402

[22] Filed: Sep. 7, 1982

[51] Int. Cl.[3] ..... F22B 21/00

[52] U.S. Cl. ..... 122/250 R; 122/367 C; 165/163

[58] Field of Search ..... 122/20 B, 367 C, 250 R, 165/163

[56] References Cited

U.S. PATENT DOCUMENTS

| | | | |
|---|---|---|---|
| 2,163,199 | 6/1939 | Hart | 122/250 R |
| 3,534,712 | 10/1970 | Reynolds | 122/367 C |
| 3,612,004 | 10/1971 | Cancilla et al. | 122/367 C |
| 3,991,821 | 11/1976 | Cook et al. | 122/20 B |
| 4,097,224 | 6/1978 | Cooksley | 122/367 C |
| 4,291,649 | 9/1981 | Bider | 122/20 B |

*Primary Examiner*—Edward G. Favors

*Attorney, Agent, or Firm*—Bauer & Amer

[57] ABSTRACT

In a heat exchanger of the type in which hot exhaust gases transfer heat to water or the like flowing through a helical heat exchange coil, the use, as a significant improvement to the efficiency of the heat exchange occurring therebetween, of a conduit for the water having external helical fluting such that the hot gases circulate along two paths, rather than only one, and thus are more effectively able to transfer heat to the water.

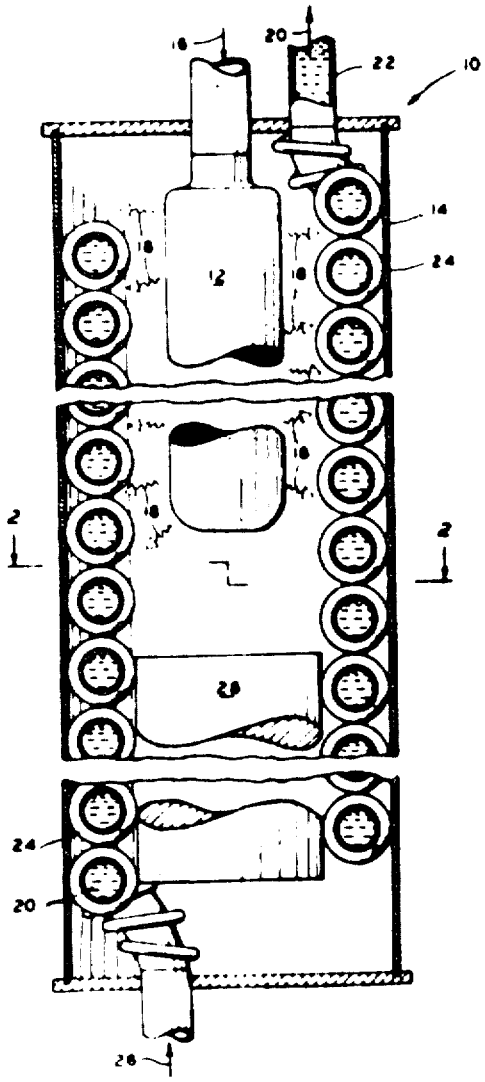

1 Claim, 4 Drawing Figures